US010933515B2

(12) United States Patent
Gunther

(10) Patent No.: US 10,933,515 B2
(45) Date of Patent: Mar. 2, 2021

(54) HIGH-TORQUE TOOL ADAPTER

(71) Applicant: Big Al's Tools LLC, Macomb, MI (US)

(72) Inventor: Alfred Gunther, Macomb, MI (US)

(73) Assignee: BIG AL'S TOOLS LLC, Macomb, MI (US)

( * ) Notice: Subject to any disclaimer, the term of this patent is extended or adjusted under 35 U.S.C. 154(b) by 289 days.

(21) Appl. No.: 16/113,290

(22) Filed: Aug. 27, 2018

(65) Prior Publication Data

US 2020/0061779 A1 Feb. 27, 2020

(51) Int. Cl.

| | |
|---|---|
| ***B25B 13/48*** | (2006.01) |
| ***B25G 1/00*** | (2006.01) |
| ***B25B 23/00*** | (2006.01) |
| ***B25B 13/46*** | (2006.01) |

(52) U.S. Cl.

CPC ..... *B25B 13/48* (2013.01); *B25B 13/462* (2013.01); *B25B 23/0007* (2013.01); *B25G 1/005* (2013.01)

(58) Field of Classification Search

CPC ..... B25B 13/005; B25B 13/06; B25B 13/48; B25B 13/462; B25B 23/0007; B25B 23/0035; B25B 23/0042; B25G 1/002; B25G 1/005; B25G 1/063; B25G 3/30

See application file for complete search history.

(56) References Cited

U.S. PATENT DOCUMENTS

| | | | | |
|---|---|---|---|---|
| 226,582 | A * | 4/1880 | Miller | B25B 13/06 81/124.4 |
| 4,671,141 | A | 6/1987 | Hanson | |
| 5,086,674 | A * | 2/1992 | Her | B25B 13/06 7/138 |
| 5,461,950 | A * | 10/1995 | Iwinski | B25B 13/463 81/61 |
| 5,664,467 | A | 9/1997 | Breeze | |
| 5,692,420 | A | 12/1997 | Byers | |
| 6,286,395 | B1 * | 9/2001 | Frazier | B25B 13/005 81/124.7 |
| 6,382,054 | B1 * | 5/2002 | Kirk | B25B 13/04 81/124.4 |
| 6,938,521 | B1 * | 9/2005 | Skeens | B25B 13/461 81/177.2 |
| 7,040,200 | B2 * | 5/2006 | Lin | B25B 13/005 81/177.5 |
| 7,228,766 | B1 * | 6/2007 | Shyu | B25B 13/005 81/125.1 |
| 7,506,877 | B1 | 3/2009 | Henderson et al. | |

(Continued)

*Primary Examiner* — David B. Thomas

(74) *Attorney, Agent, or Firm* — The Dobrusin Law Firm, P.C.; Bryan S. Lemanski

(57) ABSTRACT

A tool adapter to aid in the removal of a threaded fastener from an article using a drive insert, the tool adapter comprising: (i) a housing comprising a plurality of faces interconnected along one or more respective edges of the plurality of faces to form the housing; and (ii) one or more holes recessed into one or more of the plurality of faces, the one or more holes adapted to receive one or more tools, wherein a first mating end of the drive insert is received into one of the one or more holes of the tool adapter and a second mating end of the drive insert is connected to the threaded fastener; and wherein one or more tools are inserted into at least one of the remaining holes to provide sufficient torque to remove the fastener from the article.

20 Claims, 4 Drawing Sheets

(56) References Cited

U.S. PATENT DOCUMENTS

| | | | | |
|---|---|---|---|---|
| 8,261,638 | B2 * | 9/2012 | Hsu | B25B 13/06 81/124.4 |
| 8,307,742 | B2 * | 11/2012 | Hsu | B25B 13/56 81/124.4 |
| D674,265 | S * | 1/2013 | Greer | D8/85 |
| 10,029,360 | B2 * | 7/2018 | Sun | B25B 13/465 |
| 2004/0099102 | A1 * | 5/2004 | Vaughan | B25G 1/066 81/124.4 |
| 2007/0256525 | A1 * | 11/2007 | Lee | B25G 1/063 81/63.1 |
| 2010/0011915 | A1 * | 1/2010 | Badger | B25B 13/06 81/60 |
| 2014/0013904 | A1 * | 1/2014 | Meholovitch | B25B 13/463 81/63.2 |
| 2017/0050235 | A1 | 2/2017 | Mehalik | |
| 2017/0144280 | A1 * | 5/2017 | Shyu | B25G 1/005 |
| 2018/0126518 | A1 * | 5/2018 | Chan | B25B 13/005 |
| 2019/0217451 | A1 * | 7/2019 | Sugarman | B25B 13/48 |

* cited by examiner

HIGH-TORQUE TOOL ADAPTER

FIELD

The present teachings generally relate to a tool adapter that allows a user to create increased torque while removing a fastener from an article. More specifically, the tool adapter allows a user to provide sufficient torque to remove a locked threaded fastener due to environmental degradation or operator misuse. The tool adapter may include a housing that includes one or more holes to receive one or more tools to create the increased torque. The tool adapter may allow a user to remove a locked threaded fastener completely without breaking the fastener into multiple pieces.

BACKGROUND

Threaded fasteners are used in many industries to ensure proper connection between manufactured pieces. For example, it is common to have a plurality of threaded fasteners with a large diameter present in the body of an automobile or truck. However, these fasteners may lock in place over time due to corrosion, degradation, or operator misuse, for example. As a result, if the automobile or truck requires repairs, a mechanic may have difficulty removing the locked fasteners. A mechanic may try to use a breaker bar, propane torch, liquid penetrant, or a heavy-duty impact wrench in combination with a socket in an attempt to remove the locked fastener. Examples of removal sockets include those described in U.S. Pat. Nos. 5,664,467 and 5,692,420. However, even after excessive amounts of time and energy, the mechanic may still be unable to provide sufficient torque to remove the fastener using one of the tools identified above. The mechanic may require the aid of a specialty fabrication shop to remove the locked fasteners, which may result in additional time and money.

It may be attractive to have a tool adapter that allows a user to effectively remove a locked fastener from an article; that attaches to a plurality of tools for removing a fastener; that directly or indirectly connects to a head of a fastener for removal; that maintains the position and connection of one or more tools during user interaction; or any combination thereof. Therefore, what is needed is a tool adapter that allows a user to provide sufficient torque to remove a locked fastener. What is needed is a tool adapter with a plurality of holes to receive one or more tools to provide sufficient torque when removing a fastener. What is needed is a tool adapter that can receive a portion of a drive insert connected to a head of a fastener. What is needed is a tool adapter with one or more threaded holes to engage a threaded tool, such as a threaded pipe.

SUMMARY

The present teachings meet one or more of the present needs by providing: a tool adapter to aid in the removal of a threaded fastener from an article using a drive insert, the tool adapter comprising: (i) a housing comprising a plurality of faces interconnected along one or more respective edges of the plurality of faces to form the housing; and (ii) one or more holes recessed into one or more of the plurality of faces, the one or more holes adapted to receive one or more tools, wherein a first mating end of the drive insert is received into one of the one or more holes of the tool adapter and a second mating end of the drive insert is connected to the threaded fastener; and wherein one or more tools are inserted into at least one of the remaining holes to provide sufficient torque to remove the fastener from the article.

The present teachings meet one or more of the present needs by providing: a tool adapter to aid in the removal of a threaded fastener from an article using a drive insert, the tool adapter comprising: (i) a housing comprising a plurality of faces interconnected along one or more respective edges of the plurality of faces to form the housing; and (ii) one or more holes recessed into one or more of the plurality of faces, the one or more holes adapted to receive one or more tools, wherein a first mating end of the drive insert is received into one of the one or more holes of the tool adapter and a second mating end of the drive insert is connected to the threaded fastener; wherein one or more tools are inserted into at least one of the remaining holes to provide sufficient torque to remove the fastener from the article; and wherein the threaded fastener is locked in place in the article by corrosion, rust, cross-threading, cross-threading, or a combination thereof.

The present teachings provide: a conveyor system comprising: A tool adapter to aid in the removal of a threaded fastener from an article using a square drive insert, the tool adapter comprising: (i) a housing comprising a plurality of faces interconnected along one or more respective edges of the plurality of faces to form a solid structure of the housing; and (ii) one or more holes bored into one or more of the plurality of faces, the one or more holes adapted to receive one or more tools, wherein a first mating end of the square drive insert is received into one of the one or more holes of the tool adapter and a second mating end of the square drive insert is connected to the threaded fastener; wherein one or more tools are inserted into at least one of the remaining holes to provide sufficient torque to remove the fastener from the article; wherein the threaded fastener is locked in place in the article by corrosion, rust, cross-threading, cross-threading, or a combination thereof; and wherein the one or more tools are a breaker bar, a threaded pipe, a ratchet wrench, or a combination thereof.

DETAILED DESCRIPTION

Figure 1:
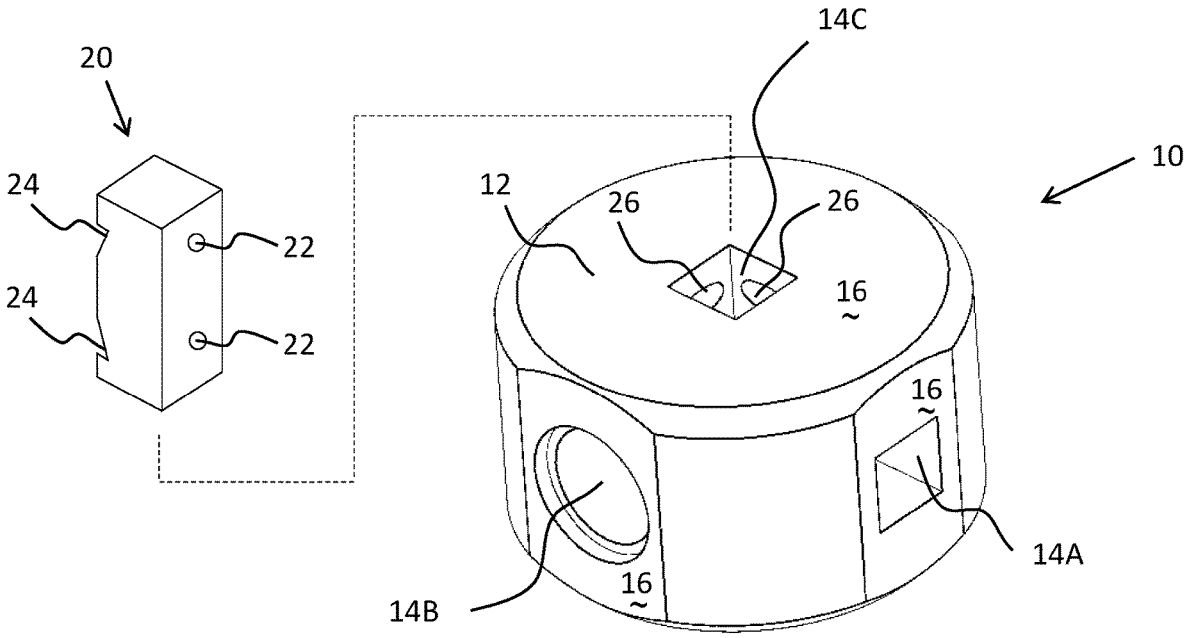
FIG. 1 is an exploded perspective view of a tool adapter having a drive insert.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to a tool adapter for removing a threaded fastener from one or more articles. The tool adapter may connect to one or more drives, one or more sockets, one or more tools, a threaded fastener, or a combination thereof. The tool adapter may directly or indirectly connect to a threaded fastener. For example, a hole of the tool adapter may directly attach to a head of a threaded fastener. Preferably, the tool adapter may connect to a threaded fastener using a drive insert. The tool adapter may be a uniform piece or may comprise a plurality of components. The tool adapter may include one or more layers. For example, the tool adapter may include a core formed of a structurally rigid polymeric material and an exterior shell of a metallic material, such as cast iron. The tool adapter may be formed, at least in part, from one or more metals, such as iron, steel (e.g., alloy steels, such as tool steel or High-Strength Low-Alloy (HSLA) steel, 1008/1010 steel, heat treated mid to high-carbon steel, stainless steel, or a combination thereof), tungsten, molybdenum, cobalt, vanadium, copper, chromium, brass, nickel, aluminum, or a combination thereof. The tool adapter may be formed, at least in part, from non-metal materials, such as a polymeric material, polyamide, polycarbonate, polypropylene, polystyrene, thermoplastics, thermosets, elastomers, or a combination thereof. The tool adapter may include additional strengthening additives, such as fibers (e.g., glass fibers, carbon fibers, metallic fibers, polymeric fibers), minerals, or a combination thereof. The tool adapter may include an exterior coating to protect from rust, corrosion, physical damage, operator misuse, other environmental degradation, or a combination thereof. The exterior coating may be an electrochemical coating (i.e. e-coating), zinc, fluoropolymer, epoxy, phenolic, phosphate, or a combination thereof. The tool adapter may include one or more tools integrally formed into the tool adapter. For example, the tool adapter may include a ratchet wrench integrally formed with a portion of the tool adapter. The tool adapter may include one or more attachment mechanisms for the one or more drives, one or more sockets, one or more tools, fastener, or a combination thereof. The one or more attachment mechanisms may be a mechanical attachment (e.g., one or more clips, hooks, snaps, straps, the like, or a combination thereof), adhesive, fastener, or a combination thereof. The one or more attachment mechanisms may be a hole or opening to receive an end portion of the one or more drives, one or more sockets, one or more tools, fastener, or a combination thereof. The tool adapter may include one or more female connecting portions, one or more male connecting portions, or a combination thereof. For example, the tool adapter may include a female connecting portion (i.e., a hole) that receives a male portion of the one or more drives, one or more sockets, one or more tools, fastener, or a combination thereof. The tool adapter may be configured for a ½-inch drive, ¾-inch drive, 1-inch drive, or a combination thereof. The tool adapter may be configured for a drive larger than 1-inch, smaller than ½-inch, or both.

The tool adapter may include a housing. The housing may function to provide a base for the connection of the tool adapter to one or more drives, one or more sockets, one or more tools, a threaded fastener, or a combination thereof. The housing may be a solid piece. The housing may have one or more hollow portions. The housing may include one or more strengthening ribs internally or externally to provide additional structural support to the housing. The housing may be formed from one or more metals, such as iron, steel (e.g., High-Strength Low-Alloy (HSLA) steel, 1008/1010 steel, high-carbon steel, stainless steel, or a combination thereof), tungsten, molybdenum, cobalt, vanadium, copper, chromium, brass, nickel, aluminum, or a combination thereof. The housing may include non-metal materials, such as polyamide (e.g., nylon), polycarbonate, polypropylene, polystyrene, thermoplastics, thermosets, elastomers, or a combination thereof. The housing may be comprised of a single material or multiple materials (e.g., a combination of both metal and non-metal material). The housing material may include additional strengthening additives, such as glass, carbon, polymeric and/or metallic fibers; minerals; or a combination thereof. The housing may be formed through injection-molding, blow-molding, thermoforming, casting, machine stamping, welding, extrusion, forging, or a combination thereof. The housing may be a single integrally formed piece or a plurality of individual pieces assembled together to create the housing. The housing may comprise one or more layers. For example, the housing may include a polycarbonate layer, a steel layer, a polypropylene layer, an aluminum layer, or a combination thereof. The housing may include a single layer. The housing may be a single hardened steel piece. The housing may have areas that vary in quantity and/or types of layers. For example, the housing may include a plurality of layers in one section while a second section has fewer layers or a greater number of layers. The housing may have a plurality of layers surrounding one or more holes to connect one or more tools, and a different distribution of layers (e.g., a single layer) for the remainder of the housing. The housing may vary in dimensional size and shape. The housing may be generally round, oval, rectangular, trapezoidal, square, symmetrical, asymmetrical, oblong, or a combination thereof. The housing may have one or more generally straight or flat sections. The housing may have one or more generally curved sections. For example, the housing may have a plurality of substantially flat faces connected by a plurality of arcuate portions that form a perimeter of the housing. The housing may include one or more chamfered sections, one or more fillets, or both. The housing may have one or more angled sections (e.g., where two or more generally straight sections intersect).

The housing may be any shape, material, or dimensions capable of withstanding the stresses or applied forces thereto. The housing may be flexible or have one or more generally flexible portions. The housing may substantially maintain shape during operation. For example, the housing may maintain shape when under rotational force (i.e., torque). The housing may maintain shape at about 150 newton meters (Nm) or more of torque, about 300 Nm of torque or more, or about 450 Nm of torque or more. The housing may maintain shape at about 800 Nm of torque or less, about 650 Nm of torque or less, or about 500 Nm of torque or less. The limiting factor may be the shear strength of the insert.

The housing may have one or more features that increases the strength of the housing to withstand such forces. The housing itself may be reinforced with one or more ribs. The housing may be hollow and filled with a material, such as a structural adhesive or additive, that increases the strength of the housing while minimally increasing the weight of the housing (e.g., about 40 percent increase in weight or less, about 30 percent increase in weight or less, about 20 percent increase in weight or less, or about 10 percent increase in weight or less). For example, the housing may be made of metal and the hollow space may be filled with a structural foam that rigidifies the housing.

The housing may include one or more faces interconnected along one or more exterior surfaces of the housing. The one or more faces may function to substantially form or define the shape of the housing. The one or more faces may function to provide a connection surface between the tool adapter and one or more drives, one or more sockets, one or more tools, a threaded fastener, or a combination thereof. The one or more faces may be substantially flat or planar. The one or more faces may be concave (e.g., having a point or area extending into the housing). The one or more faces may be convex (e.g., having a point or area extending away from the housing). The one or more faces may include one or more holes to receive one or more drives, one or more sockets, one or more tools, a threaded fastener, or a combination thereof.

The one or more faces may be integrally formed together or may be individual pieces connected together. The one or more faces may be connected using one or more fasteners, one or more adhesives, one or more joining techniques, one or more mechanical joints, or a combination thereof. The one or more fasteners may be a screw, nail, rivet, bolt, clip, staple, hinge, the like, or a combination thereof. The one or more joining techniques may include welding, soldering, brazing, heat staking, the like, or a combination thereof. The one or more adhesives may be glue, epoxy, polymer adhesives, rubber adhesives, or a combination thereof. The one or more mechanical joints may be press-fit (i.e., a male portion of a first face is inserted into a female portion of a second face), dovetail, snap-fit, miter, tongue-and-groove, bridle, lap, spline, butt, the like, or a combination thereof. The one or more faces may be directly molded together to form the housing. The one or more faces may be surfaces of a solid piece that forms the housing (e.g., surfaces of a solid cube, chamfered surfaces of a cylindrical bar, surfaces of a rectangular bar, or a combination thereof). The one or more faces may be individual pieces that form a hollow housing (e.g., a box). The one or more faces and the joints therebetween may be structurally rigid to maintain shape and support the rotational forces applied during user operation. The one or more faces may be made of a solid material or may be hollow. The one or more faces may include strengthening ribs, beads, gussets, or a combination thereof. Two or more faces may be substantially parallel to each other. One or more faces may be substantially perpendicular to another face. Two or more faces may form an angle that is neither substantially parallel nor substantially perpendicular. For example, a first face and a second face of the housing may form an angle of about 80 degrees or less, about 60 degrees or less, about 40 degrees or less, or about 20 degrees or less. The first face and second face may form an angle of about 100 degrees or more, about 120 degrees or more, about 140 degrees or more, or about 160 degrees or more.

One or more holes may extend from or between the one or more faces. The one or more holes may function to connect one or more drives, one or more sockets, one or more tools, a threaded fastener, or a combination thereof to the tool adapter. The one or more holes may function to directly or indirectly attach the tool adapter to a threaded fastener. The one or more holes may be a recess in one or more faces of the housing. The one or more holes may be bored in one or more faces of the housing. The one or more faces of the housing may be stamped, cut, punched, tapped, drilled, drawn, a combination thereof, or any other method capable of forming a hole or opening within the face of the housing. Two or more holes may be located on substantially parallel opposing faces and form a cavity within the housing. For example, a first hole located on a first face may be connected to an opposing second hole located on a second face via an internal channel through the interior of the housing. The one or more holes may form a channel such that one or more tools may be inserted into the hole from a first face and protrude from the hole on an opposing second face. For example, a square tool such as a square bar may be inserted into a rectangular tool hole and extend through a thickness of the tool adapter so that one or more users may grip each end of the pipe to provide increased torque to remove a locked fastener. The one or more holes may be recessed at an angle relative to the one or more faces of the housing. For example, the one or more holes may be drilled at about a 10-degree angle or greater relative to a face of the housing, at about a 20-degree angle or greater, at about a 45-degree angle or greater, at about a 60-degree angle or greater, or at about an 85-degree angle or greater. The one or more holes may have a tapered bore. For example, the hole may have the largest diameter at the face, and the diameter may gradually decrease as the hole or opening extends into the housing.

The one or more holes may vary in dimensional size and shape. The one or more holes may be round, oval, polygonal, rectangular, trapezoidal, square symmetrical, asymmetrical, oblong, the like, or a combination thereof. For example, the one or more holes may be substantially square to receive one or more square drive inserts connected to a fastener, ratchet wrench, socket, or a combination thereof. The one or more holes may be hexagonal or octagonal. The one or more holes may vary in depth. The one or more holes may extend through the entire face of the housing (e.g., if the faces define a hollow box). The one or more holes may have a depth (i.e., thickness) substantially similar to one or more faces of a hollow housing. The one or more holes may have a thickness of about 2 mm or more, about 4 mm or more, about 6 mm or more, or about 8 mm or more. The one or more holes may have a thickness of about 16 mm or less, about 14 mm or less, about 12 mm or less, or about 10 mm or less. The one or more holes may have a depth substantially similar to the thickness of the housing. The one or more holes may be drilled substantially through one or more faces of a solid housing. The one or more holes may extend through the entirety of the housing (e.g., from one face to an opposing face). The one or more holes may include an internal threading to connect to one or more tools to eliminate unwanted movement of the one or more tools during use. For example, the one or more holes may include a threading that mates to an external threading of a pipe. The one or more holes may be free of an internal threading. For example, the one or more holes may be a rectangular tool hole free of threading that receive one or more secondary tools. The one or more holes may include one or more mechanical fasteners to aid in connection to one or more drives, one or more sockets, one or more tools, a threaded fastener, or a combination thereof. For example, the hole may include one or more clips that secure a tool received into the hole. The one or more holes may receive a drive insert to connect the tool adapter to a fastener. The drive insert hole may secure a drive insert during use of the tool adapter.

The drive insert hole may include a plurality of recesses that engage one or more engaging features of the drive insert. The one or more recesses may be located anywhere along an interior channel of the hole. The one or more recesses may have a shape that is substantially similar to a shape of the engaging features of the drive insert. For example, the recesses may be semi-circular to receive a semi-circular engaging feature of the drive insert. The one or more recesses may be integrally formed with the holes. The one or more recesses may be notched, or cut away from a channel of the hole. The one or more recesses may be any size and shape necessary to receive the engaging features of the drive insert. The one or more recesses may be located substantially along a longitudinal plane of the holes. The one or more recesses may be positioned offset from the longitudinal plane of the holes. The one or more recesses may releasably engage one or more engaging features of the drive insert so that the drive insert may remain securely in the tool adapter during operation, yet be removed or repositioned after use of the tool adapter.

The drive insert may function to connect the tool adapter to a fastener such that an operator can increase rotational force on the fastener. The drive insert may function to connect the tool adapter to one or more tools. A plurality of drive inserts may be received by the one or more holes of the tool adapter simultaneously. For example, a first drive insert may connect the tool adapter to a fastener and a second drive insert may connect the tool adapter to a ratchet wrench. The drive insert may have one or more mating ends that can be received by one or more holes of the tool adapter, one or more fasteners, one or more sockets, one or more tools, or a combination thereof. The drive insert may have at least one mating end, at least two mating ends, at least three mating ends, or at least four mating ends. The drive insert may have mating ends that are dissimilar in size and shape. For example, a first mating end may be a square drive shape and a second mating end may be a hexagonal drive shape. The drive insert may have at least two mating ends that are substantially similar (i.e., a first and second mating end can both be received by the one or more holes of the tool adapter, one or more fasteners, one or more sockets, one or more tools, or a combination thereof). The drive insert may be made from a similar material compared to the tool adapter or made be made of a different material. The drive insert may vary in dimensional size and shape. The drive insert may have a cross-section that is round, oval, polygonal, rectangular, trapezoidal, square symmetrical, asymmetrical, oblong, or a combination thereof. The drive insert may be about 2 centimeters in length or more, about 4 centimeters in length or more, about 6 centimeters in length or more, about 8 centimeters in length or more, about 10 centimeters in length or more, or about 12 centimeters in length or more. The drive insert may be about 24 centimeters in length or less, about 22 centimeters in length or less, about 20 centimeters in length or less, about 18 centimeters in length or less, or about 16 centimeters in length or less. The drive insert may be adapted to connect to a metric sized screw (e.g., #00, #0, #1, #2, #4) or may be adapted to connect to a US measurement sized screw (e.g., 1/16", 1/8", 1/4", 1/2"). The drive insert may be a single square drive, a double-square drive (e.g., an 8-pointed star drive), or a triple-square drive (e.g., a 12-pointed star drive). The drive insert may be a single hexagonal drive or a double hexagonal drive. The drive insert may be a Phillips drive or a flat-head drive. The drive insert may be secure in the tool adapter during operation of the tool adapter, before operation of the tool adapter, after operation of the tool adapter, or a combination thereof. For example, the drive insert may be secured in a drive insert hole of the tool adapter prior to use of the tool adapter and be substantially flush or recessed with one or more faces of the tool adapter. For operation, the drive insert may then be extended within the drive insert hole so that a portion of the drive insert protrudes from the drive insert hole to connect to one or more secondary tools.

The drive insert may have one or more engaging features that engage the one or more holes of the tool adapter, one or more fasteners, one or more tools, or a combination thereof. The engaging features may function to provide additional support when inserting a drive insert into the one or more holes of the tool adapter, one or more fasteners, one or more tools, or a combination thereof. The engaging features may function to eliminate unwanted movement of the drive insert when connected to the one or more holes of the tool adapter, one or more fasteners, one or more sockets, one or more tools, or a combination thereof. The engaging features may instead, or in addition, be located within the tool adapter (e.g., within one or more holes). The engaging features may protrude from one or more surfaces of the drive insert or of one or more surfaces defining the openings or holes in the tool adapter, for example. The engaging features may be integrally formed with the drive insert. The engaging features may be spring-loaded arms that engage one or more internal walls of the one or more holes of the tool adapter, one or more fasteners, one or more sockets, one or more tools, or a combination thereof. The engaging features may include one or more biasing members to bias the drive insert against one or more walls of the drive insert hole. For example, the engaging features may include one or more spring ball plungers the bias the drive insert against walls of the drive insert hole, yet may compress so that the drive insert may be removed from the tool adapter. The engaging features may be separate pieces that are joined to the drive insert (e.g., fastened or adhered to the drive insert or one or more ball bearings inserted into one or more sockets of the drive insert). The engaging features may include one or more bearings to alleviate friction when inserting the drive insert into the one or more holes of the tool adapter, one or more fasteners, one or more sockets, one or more tools, or a combination thereof. The engaging features may be located near one or more mating ends of the drive insert. The engaging features may be located near a center of the drive insert. The engaging features may include a biasing element to provide additional tension when inserting the drive insert into the one or more holes of the tool adapter, one or more fasteners, one or more sockets, one or more tools, or a combination thereof. For example, the engaging features may include a spring to aid in biasing the engaging features towards one or more internal walls of the one or more holes of the tool adapter, one or more fasteners, one or more sockets, one or more tools, or a combination thereof.

The drive insert may include one or more retaining features. The retaining features may function to maintain a position of the drive insert relative to the tool adapter. The retaining features may prevent unwanted removal of the drive insert from a hole of the tool adapter. The retaining features may engage one or more clips positioned within the tool adapter to prevent unwanted movement of the drive insert. The retaining features may be a recess, hole, notch, cutout, groove, tooth, or a combination thereof integrally formed with the drive insert. The retaining features may include one or more arcuate portions, one or more substantially planar portions, one or more linear portions, or a combination thereof. The retaining features may be positioned anywhere along the drive insert so that the retaining features engage one or more clips of the tool adapter. The retaining features may include one or more friction surfaces to increase friction between the retaining features and the one or more clips. The retaining features may be any size and shape. For example, the retaining features may substantially triangular notches in the drive insert the engage the one or more clips.

The clip may function to engage the retaining features of the drive insert to prevent movement of the drive insert in one or more directions. The clip may function to prevent unwanted removal of the drive insert form a drive insert hole of the tool adapter. The clip may work in conjunction with the one or more engaging features to maintain a position of the drive insert. The clip may maintain a position of the drive insert free of one or more engaging features. The clip may include one or more compressible portions, one or more structurally rigid portions, or both. The clip may be positioned in one or more holes of the tool adapter to engage the drive insert. For example, the clip may be positioned in a rectangular tool hole of the tool adapter that intersects a drive insert hole so that, when the drive insert is positioned in the drive insert hole, the clip engages a retaining feature of the drive insert. The clip may allow movement of the drive insert in one direction, but prevent movement in an opposing direction.

The clip may include a body. The body may function to connect one or more biasing portions of the clip, one or more locking mechanisms of the clip, or both. The body may be substantially rigid. The body may be flexible. The body may be any size and shape. The body may be any size and shape that may be inserted into one or more holes of the tool adapter.

One or more biasing portions may project from the body of the clip. The biasing portions may function to bias a position of the clip in the tool adapter. The biasing portions may be compressible. The biasing portions may extend from one or more surfaces of the body. The biasing portions may be integrally formed with the body. The biasing portions may be any size and shape to engage an interior channel of the holes of the tool adapter. The biasing portions may be a spring, elastic wing, compressible member, elastic member, or a combination thereof. The biasing portions may be a plurality of biasing portions. For example, the plurality of biasing portions may be a pair of biasing portions, three or more biasing portions, or four or more biasing portions. The plurality of biasing portions may be six or less biasing portions, five or less biasing portions, or four or less biasing portions. The biasing portions may engage one or more surfaces of a channel of the holes. The biasing portions may maintain a position of the clip so that a locking mechanism engages the drive insert.

The locking mechanism may function to engage the retaining features of the drive insert and secure a position of the drive insert relative to the tool adapter. The locking mechanism may function to prevent removal of the drive insert from a drive insert hole of the tool adapter. The locking mechanism may be any portion of the clip that contacts the drive insert. The locking mechanism may be any size and shape to engage the retaining features of the drive insert. The locking mechanism may be any projection, extension, protrusion, or a combination thereof of the clip. The locking mechanism may be compressible. For example, the locking mechanism may extend into the retaining feature of the drive insert to secure drive insert in the tool adapter, yet the locking mechanism may be compressed to disengage the locking mechanism from the retaining feature of the drive insert to remove the drive insert form the tool adapter. The clip may include a single locking mechanism or a plurality of locking mechanism. The locking mechanism may include one or more linear segments, one or more arcuate portions, one or more angles, one or more joints, one or more contours, or a combination thereof. The locking mechanism may be integrally formed with the clip or may be a secondary component. Substantially all of the locking mechanism or a portion of the locking mechanism may be elastically deformable.

One or more tools may be connected to the tool adapter. The one or more tools may function to aid an operator in providing sufficient rotational force to a fastener. The one or more tools may create a moment arm sufficiently long relative to the center of a fastener to create enough torque to remove the fastener. The one or more tools may have a length of about 0.2 meters or more, about 0.4 meters or more, about 0.6 meters or more, about 0.8 meters or more, or about 1 meter or more. The one or more tools may have a length of about 2 meters or less, about 1.8 meters or less, or about 1.5 meters or less. The one or more tools may connect to the one or more holes of the housing, one or more drive inserts, one or more sockets, or a combination thereof. The one or more tools may connect to the one or more holes such that the one or more tools are cantilevered (i.e., the one or more tools are fixed at one end that is received by the one or more holes). The one or more tools may extend through a cavity formed between two or more holes. For example, a pipe may be inserted into a first hole, extend through a cavity in the housing, and protrude from a second hole on an opposing face of the housing. The one or more tools may be a pipe, pole, arm, level, or a combination thereof. The one or more tools may be a ratchet, wrench (e.g., an air impact wrench, mechanical wrench, or both), screwdriver, breaker bar, wrecking bar, tanker bar, crowbar, pry bar, hammer, chisel, or a combination thereof. The one or more tools may include a threading to mate with the one or more holes of the tool adapter. The threading may be on an interior surface or an exterior surface of the one or more tools. The one or more tools may be sufficiently rigid to withstand the rotational force required to remove a locked fastener. The one or more tools may be sufficiently rigid to withstand the rotational force required to properly engage a fastener in an article. The one or more tools may include one or more hinges to adjust an angle of the one or more tools relative to the tool adapter. The adapter may include one or more interfaces to secure the tools to the adapter. For example, the adapter may include a first threaded interface to connect to a pipe and a second mechanical interface to secure a tanker bar.

Turning now to the figures, FIG. 1 illustrates an exploded perspective view of an exemplary tool adapter 10. The adapter 10 is formed by a housing 12 including a plurality of holes 14. The housing 12 includes a plurality of faces 16 interconnected along their respective peripheral edges by one or more arcuate portions to define the housing 12. Each hole 14 extends into the housing 12 in a direction substantially perpendicular to one or more of the faces 16. A rectangular tool hole 14A extending between opposing faces 16 of the tool adapter 10 is configured to receive one or more secondary tools. A plurality of pipe holes 14B are configured to receive a threaded pipe (see FIG. 6). The pipe holes 14B each include an internal threading (not shown) to mate with a threading of an inserted pipe. As illustrated, the tool adapter 10 includes a drive insert 20 that may be inserted into a drive insert hole 14C extending between opposing faces 16 of the tool adapter 10. The drive insert hole 14C includes a plurality of recesses 26 that receive engaging features 22 of the drive insert 20. The drive insert 20 further includes a plurality of retaining features 24 that may be engaged by one or more clips and maintain a position of the drive insert 20 when inserted into the tool adapter 10 (see FIG. 7).

Figure 2:
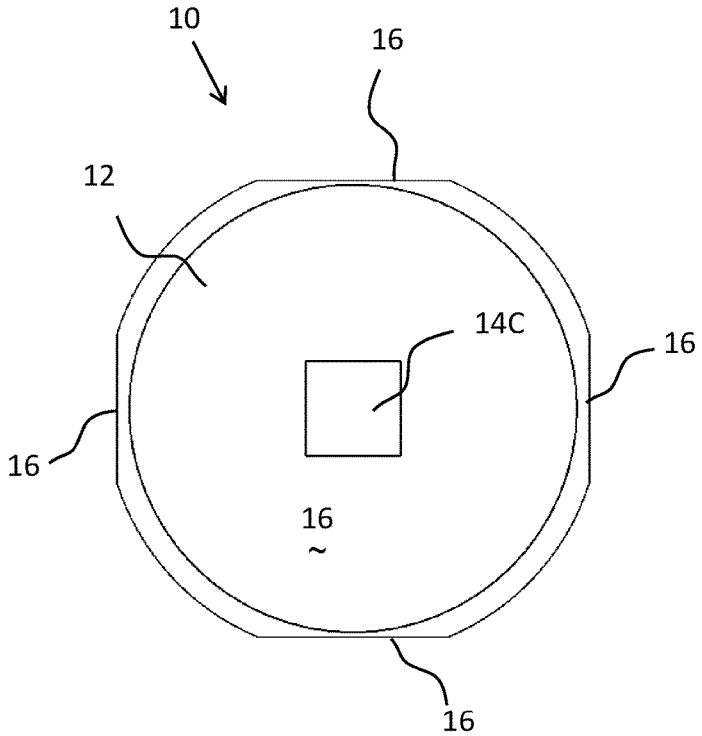
FIG. 2 is a top view of a tool adapter.

FIG. 2 illustrates a top view of a tool adapter 10. The adapter 10 comprises a housing 12 including a plurality of holes 14. The housing 12 includes a plurality of faces 16 interconnected along their respective peripheral edges by one or more arcuate portions to define the housing 12. A drive insert hole 14C extends between opposing faces 16 of the tool adapter 10 in a direction substantially perpendicular to a top face 16 of the housing 12, a bottom face of the housing (not shown), or both.

Figure 3:
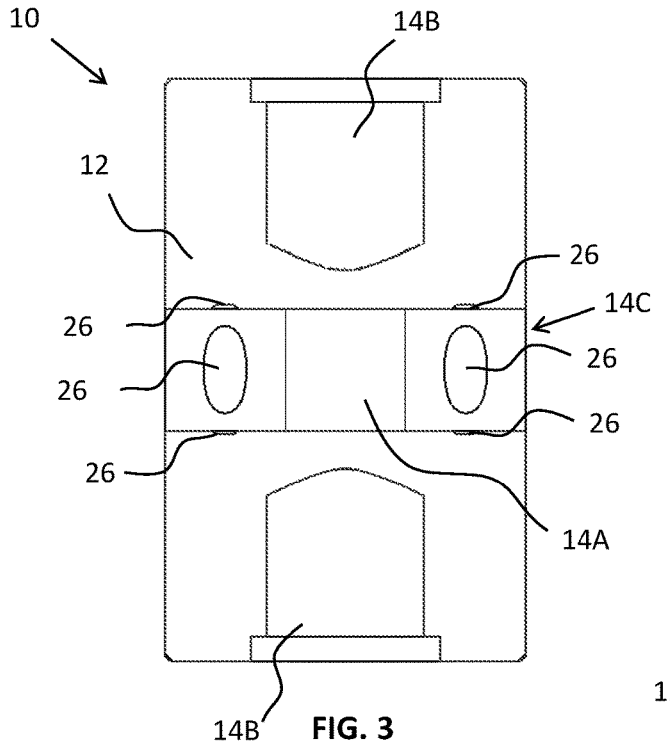
FIG. 3 is a cross-sectional view of a tool adapter.

FIG. 3 illustrates a cross-sectional view of tool adapter 10. The tool adapter 10 comprises a housing 12 including a plurality of holes 14. A plurality of pipe holes 14B extends substantially perpendicular to faces of the housing 12 (see FIG. 1). A drive insert hole 14C extending through the housing 12 is configured to receive a drive insert. The drive insert hole 14C includes a plurality of recesses 26 that receive engaging features of the drive insert (see FIG. 1). The tool adapter 10 further includes a rectangular tool hole 14A extending between opposing faces 16 of the tool adapter 10 that is configured to receive one or more secondary tools.

Figure 4:
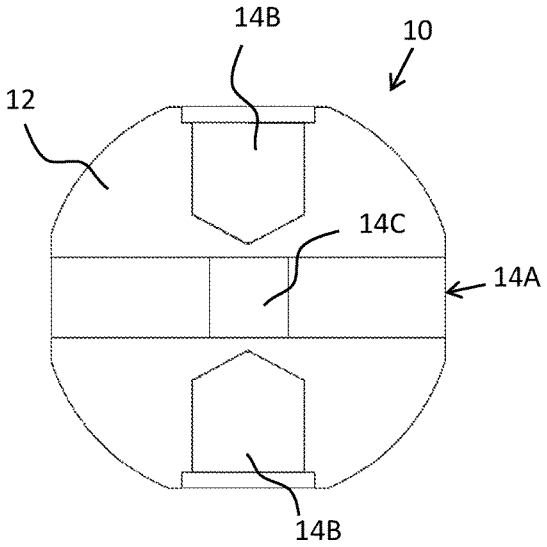
FIG. 4 is a cross-sectional view of a tool adapter.

FIG. 4 illustrates an additional cross-sectional view of a tool adapter 10. The tool adapter 10 comprises a housing 12 including a plurality of holes 14. A plurality of pipe holes 14B extend substantially perpendicular to faces of the housing 12 (see FIG. 1). A drive insert hole 14C extends through the housing 12 and is configured to receive a drive insert. The tool adapter 10 further includes a rectangular tool hole 14A extending between opposing faces of the tool adapter 10 that is configured to receive one or more secondary tools.

Figure 5:
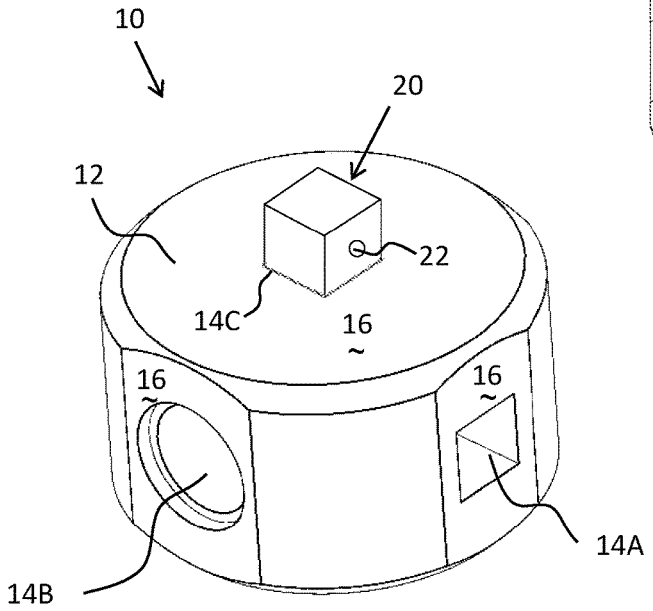
FIG. 5 is a perspective view of a tool adapter having a drive insert.

FIG. 5 illustrates a perspective view of a tool adapter 10 (illustrated as having a generally circular cross-section with a plurality of chamfered surfaces, though any cross-sectional shape is contemplated). The adapter 10 is formed by a housing 12 including a plurality of holes 14. The housing 12 includes a plurality of faces 16 interconnected along their respective peripheral edges by one or more arcuate portions to define the housing 12. Each hole 14 extends into the housing 12 in a direction substantially perpendicular to one or more of the faces 16. A rectangular tool hole 14A extending between opposing faces 16 of the tool adapter 10 is configured to receive one or more secondary tools. A plurality of pipe holes 14B are configured to receive a threaded pipe (see FIG. 6). The pipe holes 14B each include an internal threading (not shown) to mate with a threading of an inserted pipe. As illustrated, the tool adapter 10 includes a drive insert 20 secured in a drive insert hole 14C extending between opposing faces 16 of the tool adapter 10. The drive insert hole 14C includes a plurality of recesses that receive engaging features 22 of the drive insert 20 (see FIG. 1).

Figure 6:
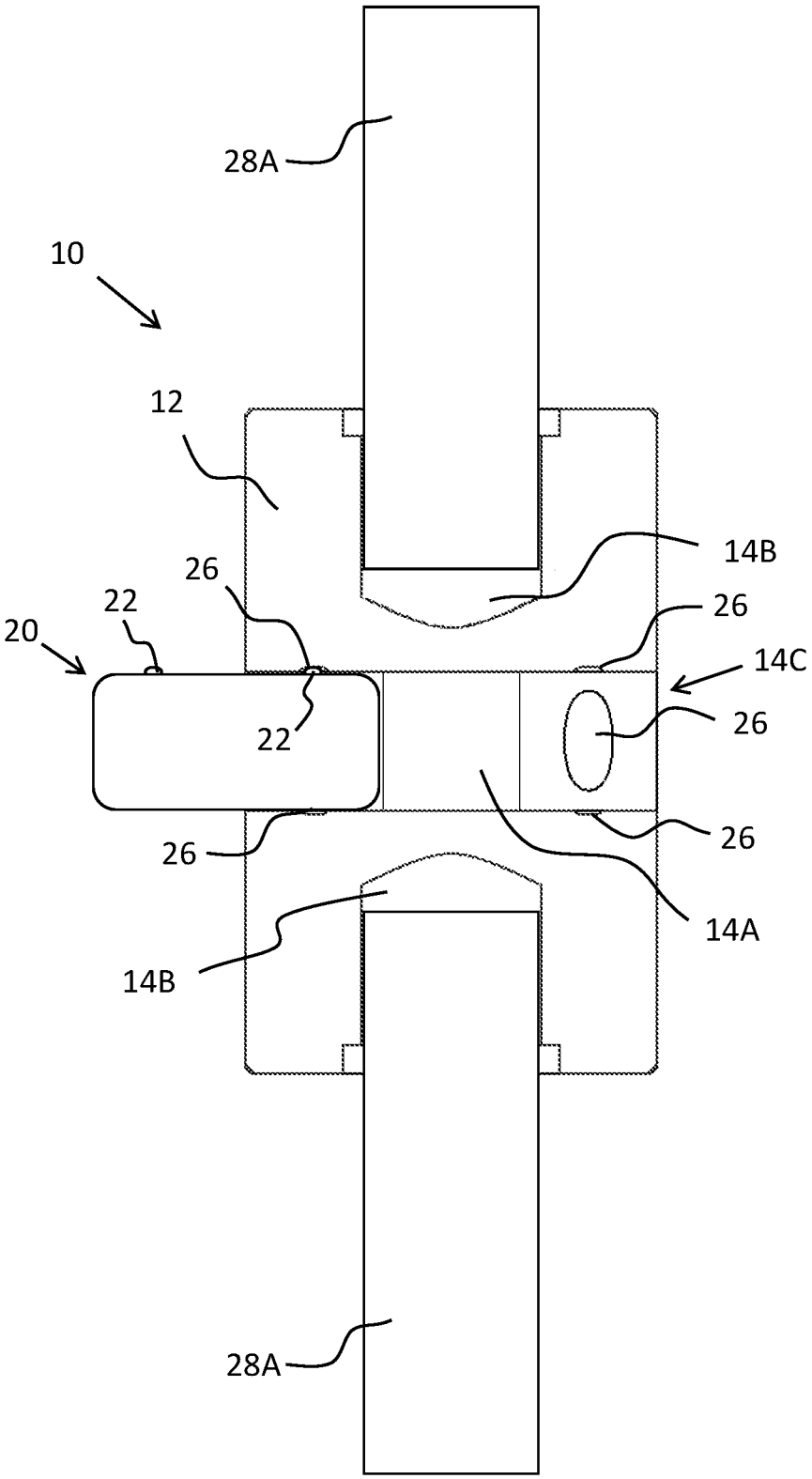
FIG. 6 is a cross-sectional view of a tool adapter connected to a plurality of tools.

FIG. 6 illustrates a cross-sectional view of a tool adapter 10 connected to a plurality of tools 28. The tool adapter 10 comprises a housing 12 including a plurality of holes 14. A plurality of threaded pipe holes 14B extending substantially perpendicular to faces of the housing 12 secure opposing threaded pipes 28A. A drive insert hole 14C extends through the housing 12 and is configured to receive a drive insert 20. The drive insert hole 14C includes a plurality of recesses 26 that receive engaging features 22 of the drive insert. The tool adapter 10 further includes a rectangular tool hole 14A extending between opposing faces 16 of the tool adapter 10 that is configured to receive one or more secondary tools.

Figure 7:
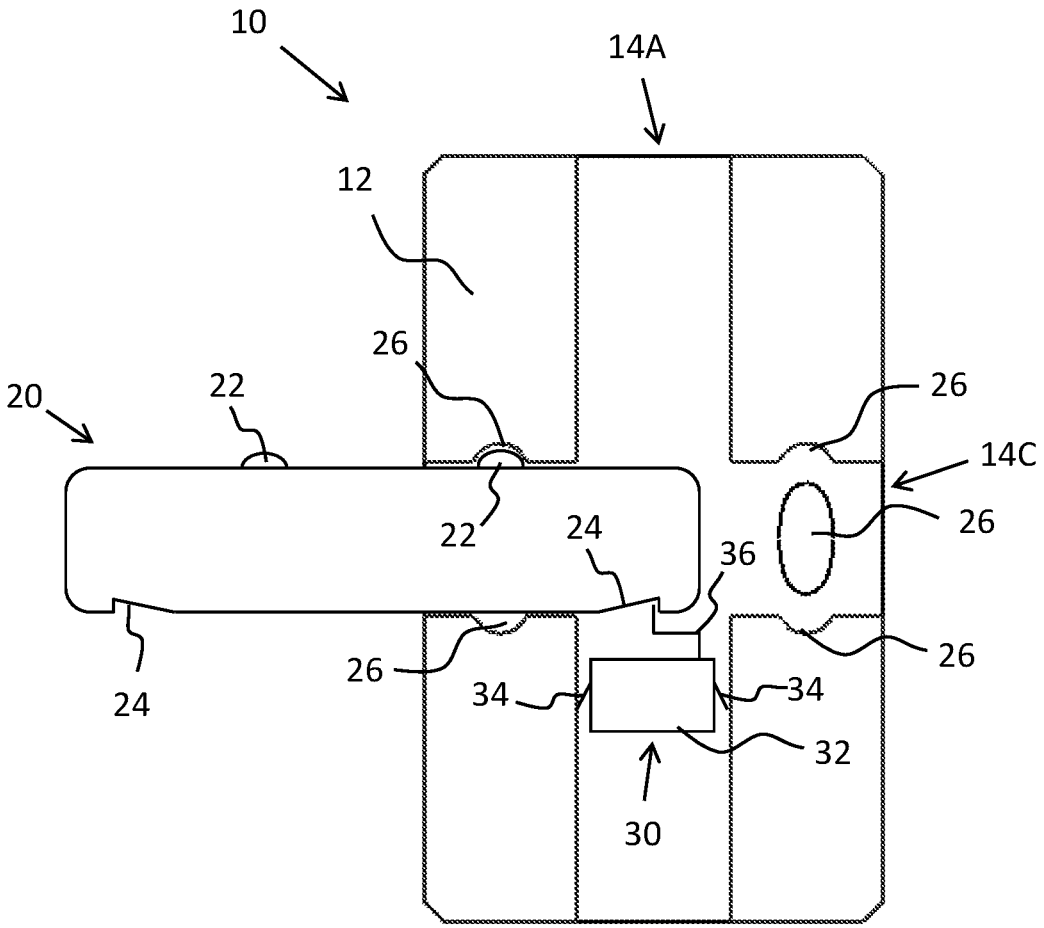
FIG. 7 is a cross-sectional view of a tool adapter.

FIG. 7 illustrates a cross-sectional view of a square drive insert 20 secured in a tool adapter 10. The tool adapter 10 comprises a housing 12 including a plurality of holes 14. A drive insert hole 14C extending through the housing 12 is configured to receive the drive insert 20. The drive insert hole 14C includes a plurality of recesses 26 that receive engaging features 22 of the drive insert. The tool adapter 10 further includes a rectangular tool hole 14A extending between opposing faces 16 of the tool adapter 10 that is configured to receive one or more secondary tools. A clip 30 is inserted into the rectangular tool hole 14A to maintain a position of the drive insert 20 within the drive insert hole 14C. The clip 30 include a plurality of biasing portions 34 protruding from a body 32 of the clip 30 that maintain a position of clip 30 within the rectangular tool hole 14A. A locking mechanism 36 of the clip 30 engages a retaining feature 24 of the drive insert 20 so that the drive insert 20 is prevented from being completely removed from the tool adapter 10.

While the figures illustrate a tool adapter having a generally circular cross-section with one or more planar faces, other shapes are also possible. For example, the adapter may have more than 6 sides or faces. The adapter may have fewer than 6 sides or faces. The adapter may have a shape that is generally triangular, square, rectangular, circular, pentagonal, hexagonal, or the like. The adapter may include more than one opening or hole in one or more of the faces. The adapter may include some faces without an opening or hole. The openings may be shaped to be generally circular, oval, triangular, square, rectangular, pentagon, hexagon, and the like. The tool adapter may include a plurality of clips or may be free of clips.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100. By way of example, a teaching of "about 100" encompasses a teaching of within a range of 100+1-15.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

I claim:

1. A tool adapter comprising:

i. a housing comprising a plurality of faces interconnected along one or more respective edges of the plurality of faces to define the housing;

ii. one or more holes formed into one or more of the plurality of faces, the one or more holes adapted to receive one or more tools; and iii. a drive insert having a first mating end removably inserted into one of the one or more holes of the tool adapter and a second mating end removably inserted into a threaded fastener or a tool;

wherein the tool adapter is configured to aid in the removal of a threaded fastener from an article.

2. The tool adapter according to claim 1, wherein the threaded fastener is locked in place in the article by corrosion, rust, cross-threading, or a combination thereof.

3. The tool adapter according to claim 1, wherein the drive insert is a rectangular drive insert.

4. The tool adapter according to claim 1, wherein at least one of the one or more holes is threaded to receive the one or more tools.

5. The tool adapter according to claim 4, wherein at least one of the one or more tools is a threaded pipe adapted to engage the threading of the one or more holes.

6. The tool adapter according to claim 1, wherein the housing is made from hardened steel.

7. The tool adapter according to claim 1, wherein the drive insert includes one or more engaging features to secure the drive insert to the tool adapter, the threaded fastener, or both.

8. The tool adapter according to claim 1, wherein at least two of the one or more holes form a cavity within the housing between opposing faces.

9. The tool adapter according to claim 1, wherein the housing is a solid structure and the one or more holes are bored into a surface of the one or more faces.

10. The tool adapter according to claim 1, wherein the one or more tools are a breaker bar, a threaded pipe, a ratchet wrench, an air impact wrench, a tanker bar, or a combination thereof.

11. A tool adapter comprising:

i. a housing comprising a plurality of faces interconnected along one or more respective edges of the plurality of faces to form the housing;

ii. one or more holes recessed into one or more of the plurality of faces, the one or more holes adapted to receive one or more tools;

iii. a drive insert configured for removable insertion into the one or more holes; and iv. a clip positioned within one of the one or more holes and secured by a biasing portion biased against an interior of the hole, wherein the clip engages the drive insert to maintain a position of the drive insert;

wherein one or more tools are inserted into at least one of the remaining holes to provide sufficient torque to remove a fastener from a article.

12. The tool adapter according to claim 11, wherein the fastener is unable to be removed using the standard torque applied when initially installing the fastener.

13. The tool adapter according to claim 11, wherein the drive insert is a square drive insert.

14. The tool adapter according to claim 11, wherein the housing is a solid structure and the one or more holes are bored into a surface of the one or more faces.

15. The tool adapter according to claim 11, wherein at least two of the one or more holes form a cavity within the housing extending between opposing faces.

16. The tool adapter according to claim 11, wherein at least one of the one or more holes is threaded to receive the one or more tools.

17. The tool adapter according to claim 11, wherein at least one of the one or more tools is a threaded pipe adapted to engage the threading of the one or more holes.

18. The tool adapter according to claim 11, wherein the one or more tools are a breaker bar, a threaded pipe, a ratchet wrench, an air impact wrench, or a combination thereof.

19. The tool adapter according to claim 11, wherein a locking mechanism of the clip engages a retaining feature of the drive insert when the drive insert is inserted into the one or more holes.

20. The tool adapter according to claim 11, wherein the clip includes a plurality of biasing portions protruding from a body of the clip that contact the interior of the hole.

* * * * *